United States Patent [19]

Marchelletta et al.

[11] 4,177,781

[45] Dec. 11, 1979

[54] ELECTROMECHANICAL ENGINE TIMING DEVICE

[75] Inventors: Ronald L. Marchelletta; Charles W. Wheeler, both of Thousand Oaks, Calif.

[73] Assignee: Moto-Tronics, Pacific Palisades, Calif.

[21] Appl. No.: 850,573

[22] Filed: Nov. 11, 1977

Related U.S. Application Data

[63] Continuation of Ser. No. 604,678, Aug. 14, 1975, abandoned.

[51] Int. Cl.[2] ..... F02P 17/00

[52] U.S. Cl. ..... 123/146.5 A; 324/391

[58] Field of Search ..... 123/146.5 A, 148 R; 73/116, 118, 119 R; 324/15, 16 T

[56] References Cited

U.S. PATENT DOCUMENTS

| | | | |
|---|---|---|---|
| 1,453,635 | 5/1923 | Morris | 324/16 T |
| 2,425,081 | 8/1947 | Bohannon | 73/118 X |
| 2,441,782 | 5/1948 | Wass et al. | 73/118 |
| 2,615,929 | 10/1952 | Rider | 123/146.5 A |
| 2,774,033 | 12/1956 | Penn | 324/16 T |
| 3,375,713 | 4/1968 | Gover | 324/16 T X |
| 3,411,071 | 11/1968 | Henry | 324/16 T X |
| 3,693,148 | 9/1972 | Pittman | 324/16 T UX |
| 3,906,917 | 9/1975 | Lorti | 123/146.5 A |

*Primary Examiner*—Charles J. Myhre
*Assistant Examiner*—Tony M. Argenbright
*Attorney, Agent, or Firm*—Jessup & Beecher

[57] ABSTRACT

An electromechanical engine timing device for installation in an ignition system distributor having one or more breaker points which provides a visual indication of maladjustments and malfunctions, permitting easy detection and correction. The system is comprised of light-emitting diodes permanently mounted within the distributor, connected in parallel with each set of breaker points to visually indicate the correct static setting of the breaker point. The light-emitting diodes are mounted on a semi-circular bracket for permanent attachment to the adjustable base plate in the ignition system distributor. The light-emitting diodes can be viewed through a transparent cover on the distributor providing a continuous indication of the proper sequencing of each breaker point by a rotating cam.

3 Claims, 7 Drawing Figures

ELECTROMECHANICAL ENGINE TIMING DEVICE

This application is a continuation of application Ser. No. 604,678, filed on Aug. 14, 1975 now abandoned.

BACKGROUND OF THE INVENTION

This invention relates generally to ignition systems and more particularly relates to devices for continuously indicating ignition system condition.

Proper ignition system adjustment is absolutely necessary in order to obtain good performance from an engine which is greatly affected by proper adjustment and sequencing of the breaker points in the distributor of the ignition system. For this purpose, usually highly sophisticated equipment must be attached to the ignition system to analyze the engine's performance in a shop. At present there is no simple way to provide adjustment and monitoring to maintain a high level of performance under field conditions.

In motorcycles a high level of performance is especially important. With this type of engine, distribution of electrical spark is provided by one or more sets of points being fired in a proper sequence. It is especially difficult to make adjustments on motorcycle engines under field conditions because limited space only permits carrying of a minimum number of tools.

SUMMARY OF THE INVENTION

The purpose of the present invention is to provide a permanently installed electromechanical ignition analyzer which permits adjustment and detection of problems with ignition systems to be performed under field conditions with a minimum amount of tools.

The ignition analyzer is a permanently installed device which is mounted in the distributor to provide an indication of proper ignition adjustment. The system will enable a novice as well as a more experienced person to static set his own ignition timing and trouble shoot the ignition system under field conditions. Light-emitting diodes mounted on a bracket shaped to be permanently installed in the distributor and connected in parallel with the breaker points provide a continuous visual indication of any maladjustments or malfunctions. A transparent cover on the distributor provides a continuous visual indication and makes problems easier to detect and correct and enables maintenance of a high level of performance from engines and particularly motorcycle engines. While the electrical connection of the invention in the ignition system is substantially similar to prior art devices, the particular electromechanical construction of the device for permanent installation in the distributor, allowing continuous observation of engine performance and permitting field adjustments without making any electrical connections is believed to be unique. Further, the usual lamps used for timing lights and such circuits cannot be permanently installed because they would load down the ignition circuit and an engine would not run or at the very least run very poorly.

It is one object of the invention to provide an electromechanical engine timing device permanently installed within the distributor of an ignition system.

Another object of the present invention is to provide an electromechanical device which is permanently installed and permits continuous monitoring of engine performance.

Still another object of the present invention is to provide a permanently installed electromechanical timing device which permits field adjustment without the need for electrical connections.

Other objects, advantages and novel features of the invention will become apparent from the following detailed description of the invention when considered in conjunction with the accompanying drawings, wherein like reference numbers identify like parts throughout.

DETAILED DESCRIPTION OF THE PREFERRED EMBODIMENT

Figure 1:
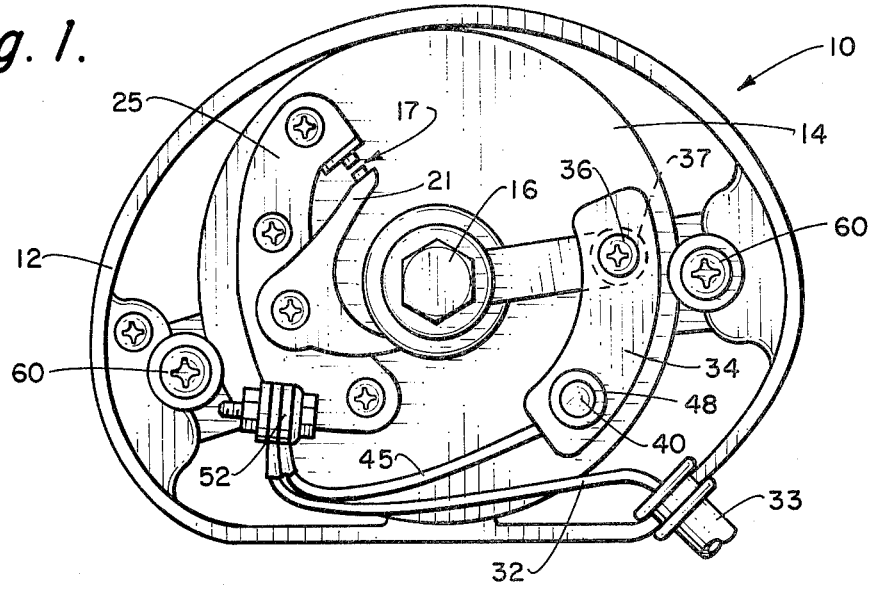
FIG. 1 is a view of the electromechanical engine timing device installed in the interior of a distributor for one type of ignition system having a single set of breaker points.
Figure 5:
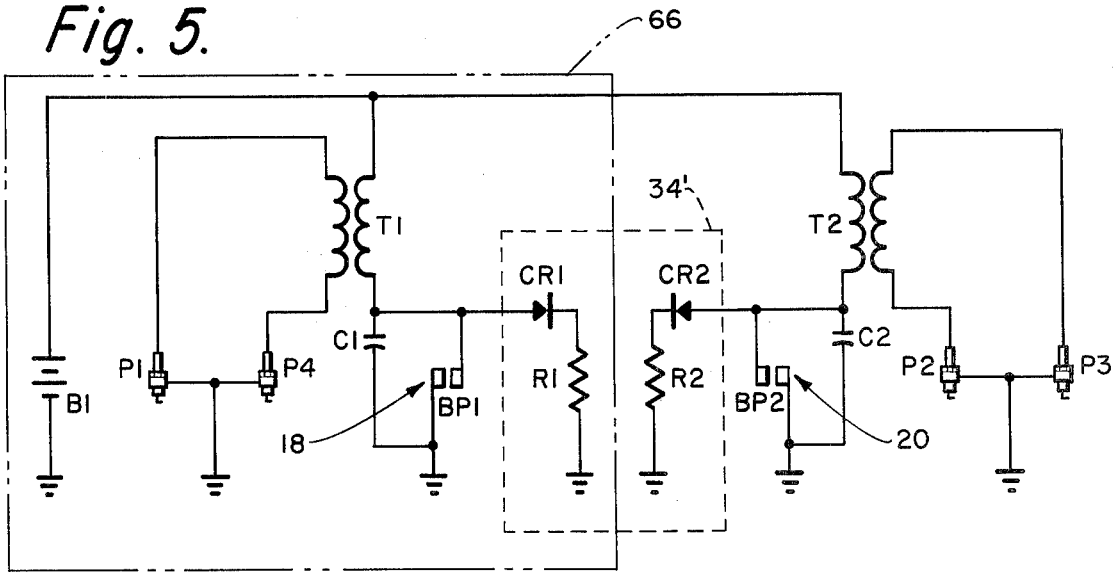
FIG. 5 is a schematic diagram showing the connection of the electromechanical engine timing device is parallel with breaker points.

Referring to FIG. 1 there is shown a distributor 10 of an ignition system, comprised of a housing 12 and base plate 14 mounted over a cam 16 for opening and closing breaker points 17. The breaker points 17 are open and closed by arm 21 sequentially operated by the cam 16. One side of the breaker point is mounted to a fixed plate 25 attached to the base plate 14 in the usual manner. Lead 32 goes to a cable 33 which connects the breaker points to a sparkplug (FIG. 5).

The electromechanical engine timing device or ignition analyzer device is mounted permanently in the distributor on a semi-circular arcuate bracket 34 attached to the base plate 14 by a screw 36 through the bracket 34. Light-emitting diode 40 is connected to the fixed side of breaker points 17 by wire 45.

Figure 2:
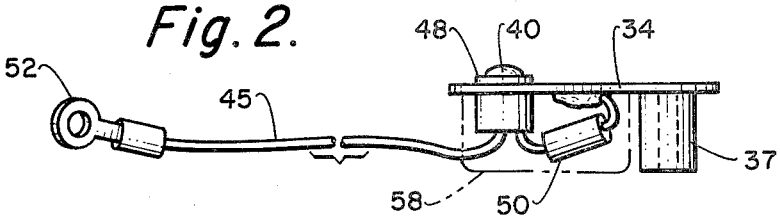
FIG. 2 is a detailed side elevation of the electromechanical engine timing device assembly for permanent installation in the distributor of FIG. 1.

The ignition analyzer assembly is shown in greater detail in FIG. 2. The semi-circular arcuate bracket 34 has a light-emitting diode 40 press-fitted and held in place by collar 48. One side of light-emitting diode 40 is connected through a resistor 50 to ground (i.e., the bracket 34). The resistor 50 limits current through the light-emitting diode 40 to approximately 10 milliamps. The other side of light-emitting diode 40 is connected by lead 45 to a lug 52. For mounting and spacing purposes, a standoff 37 is provided beneath mounting plate 34. The underside of bracket 34 may be encapsulated with a suitable plastic as shown at 58 to protect the light-emitting diode 40 and resistor 50, if desired.

Figure 3:
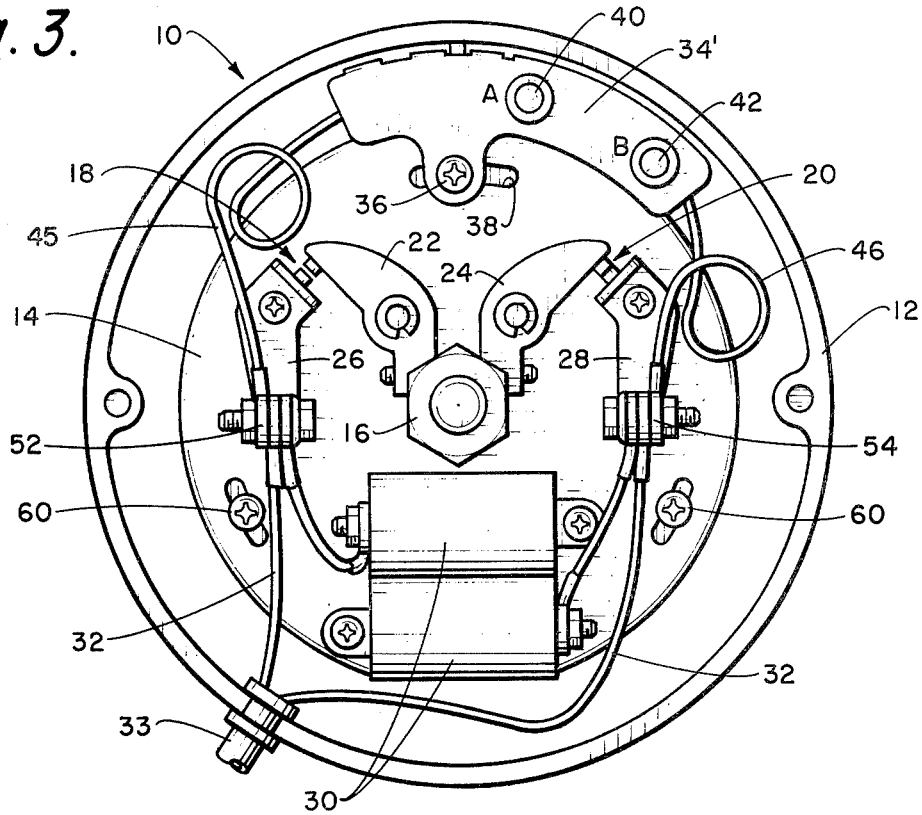
FIG. 3 is a view of an alternate embodiment of the electromechanical engine timing device installed in the interior of a distributor for an ignition system having dual breaker points.

An electromechanical engine timing device or circuit analyzer for an ignition system having a dual set of breaker points is shown in FIG. 3 in which there is shown a distributor 10, comprised of a housing 12 and a base plate 14 mounted over a cam 16 for opening and closing breaker points 18 and 20. The breaker points 18 and 20 are open and closed by arms 22 and 24 sequentially operated by the cam 16. One side of each breaker point 18,20 is mounted to a fixed plate 26 and 28 attached to the base plate 14 in the usual manner. Leads 32 go to a cable 33 which connects the breaker points to sparkplugs.

The electromechanical engine timing device is mounted permanently in the distributor on a semi-circular arcuate bracket 34' attached to the base plate 14 by a Phillips screw 36 through tang 38 on the bracket 34'. Light-emitting diodes 40 and 42 are connected respectively to the fixed side of each breaker point 18 and 20 by wires 45 and 46 respectively.

Figure 4:
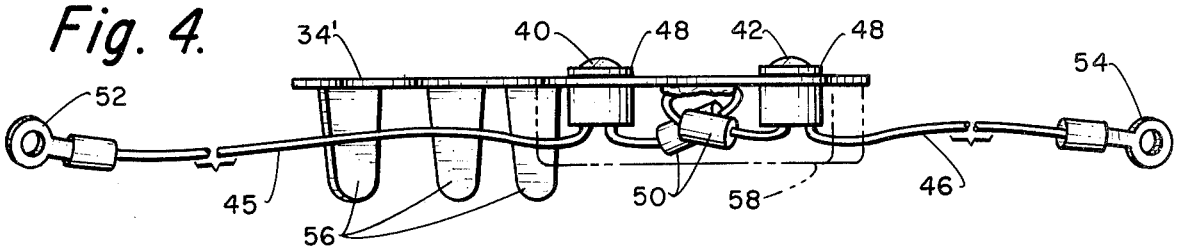
FIG. 4 is a detailed side elevation of the electromechanical engine timing device assembly for permanent installation in the distributor of FIG. 3.

The electromechanical assembly is shown in greater detail in FIG. 4. The semi-circular arcuate bracket 34' has first and second light-emitting diodes 40 and 42 press-fitted and held in place by collars 48. One side of each light-emitting diode 40, 42 is connected through resistors 50 to ground (i.e., the bracket 34'). Each resistor 50 limits current through the light-emitting diodes to approximately 10 milliamps. The other side of each light-emitting diode 40, 42 is connected by leads 45 and 46 to lugs 52 and 54 respectively. Fingers 56 on the plate 34' position or locate the ignition analyzer in the distributor by engaging existing lugs on the inside surface of the distributor housing 12. The indexing function of the fingers 56 may be performed in various distributor configurations by varying the fingers themselves or by using some other technique, if desired.

In order to protect the light-emitting diodes 40, 42, the area beneath the bracket 34' adjacent to the light-emitting diodes and resistors 50 may be encapsulated with a suitable potting compound indicated at 58, if desired. The potting compound 58 may be of any suitable type and securely fastens the light-emitting diodes and resistor circuit protecting it from corrosion, moisture and other damage.

FIG. 5 is a schematic diagram of the usual ignition system having a dual set of breaker points in which a battery B1 supplies electrical power to ignition coils T1 and T2 which provide a spark to plugs P1, P2, P3 and P4, respectively. The sparkplugs P1 through P4 correspond to the plug for ignition in cylinders 1 through 4 respectively (not shown).

The breaker points 18 and 20 provide spark to plugs P1 through P4 by discharging ignition coils T1 and T2 seqentially. Condensers C1 and C2 (i.e., 30 of FIG. 3) are connected in parallel with each set of breaker points in the usual manner of most ignition systems. The ignition analyzer is electrically connected internally in the distributor as illustrated by the dotted line 34' representing the semi-circular bracket 34'. Light-emitting diode CR1 (40) is connected in parallel with breaker point P1 through a current-limiting resistor R1 to ground. Likewise, light-emitting diode CR2 (42) is connected in parallel with breaker points P2 through current-limiting resistor R2 also to ground. Thus, the light-emitting diodes provide a visual indication of the condition of the breaker points. The current-limiting resistors R1 and R2 are small half-watt resistors having a value selected to limit the current through the limit-emitting diodes to approximately 10 milliamps.

For a single set of breaker points with two or more sparkplugs, the analyzer circuit would be connected as shown by the phantom lines 66 in FIG. 5. That is, the light-emitting diode (or diodes in the case of triple sets of breaker points) is permanently installed in the distributor in parallel with the breaker points. Thus, the circuit analyzer system disclosed can be used with any engine which can be static set or adjusted (i.e., without the engine running). For engines having a rotor and distribution points in a distributor cap a clear plastic cap can be used to view the circuit analyzer system or a window in the cap provided.

Figure 6:
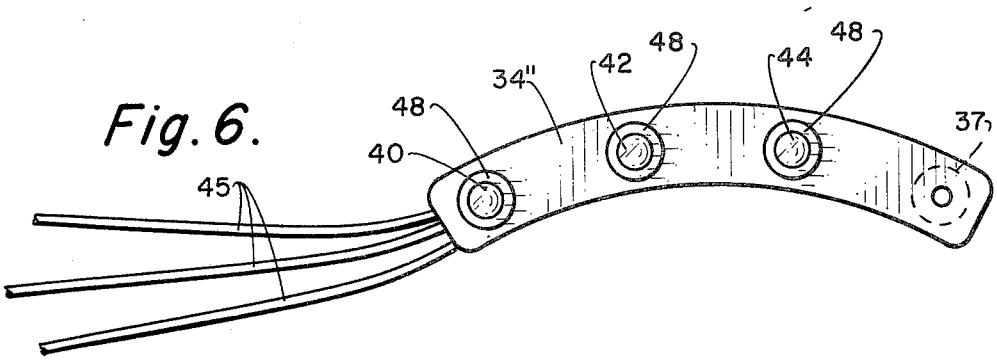
FIG. 6 is a top view of the electromechanical engine timing device assembly for permanent installation in the distributor of an ignition system having three sets of breaker points.
Figure 7:
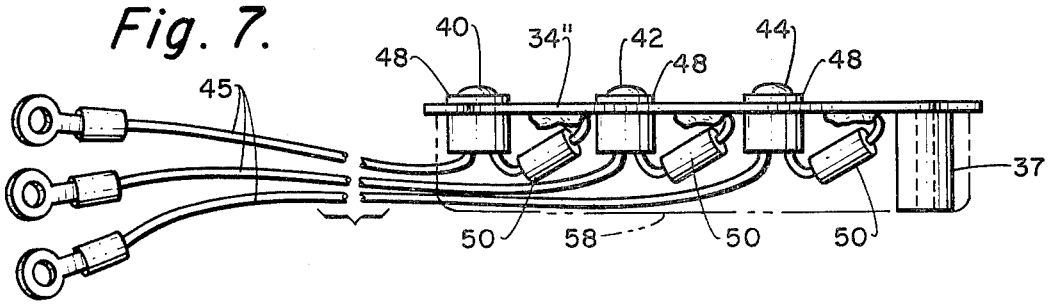
FIG. 7 is a detailed side elevation of the electromechanical engine timing device assembly of FIG. 6.

FIGS. 6 and 7 illustrate the construction of an electromechanical engine timing device or circuit analyzer for permanent installation in the distributor of a three-point ignition system (not shown). This type of ignition is used in a three-cylinder engine having a separate plug and breaker points for each cylinder. This assembly is comprised of a bracket 34" having three light-emitting diodes 40, 42 and 44 attached. Each diode has a resistor 50 in series as before and is connected in parallel with each set of breaker points as illustrated in FIG. 5. A standoff 37 is provided and the entire circuit beneath the bracket 34" encapsulated as before for protection.

The three-point engine ignition analyzer is installed in the same manner as the two-point analyzer by removing the distributor cover and removing a top base plate screw. The screw is placed through the hole in the bracket 34" and threaded back into the base plate 14. The lead wires 45 are then connected to the fixed side of each set of breaker points as usual.

In order to use the electromechanical ignition analyzer for adjustment purposes, the breaker point gap 18 and 20 (or 17 in the embodiment of FIG. 1) are first set to factory specifications in the normal manner with a feeler gauge. With the ignition switch on and the breaker point gap correctly adjusted, the cam 16 is rotated in a clockwise direction until a timing mark is aligned with an index mark. At this time a lamp should fire, indicating that the ignition analyzer is operating properly and the timing adjustment is properly set. If the lamp should fire before or after alignment of the marks, the base plate must be adjusted. This is done by loosening the base plate locking screws 60 and 36 in the embodiment of FIG. 3. The locking screw has the dual function of locking the base plate and also holding the bracket 34' in place. Once the base plate 14 has been loosened, it is rotated right or left until the lamp just fires. The base plate locking screws 60 and 36 are then retightened. The lamp firing is then rechecked by again rotating the cam 16 clockwise until the timing mark and timing index marks are aligned. By rotating the cam 16 of the dual system 180°, the firing for cylinders 2 and 3 can be checked using the same procedure for the alignment of the first two cylinders. If the two lamps overlap, it indicates that the points are open to maximum tolerance or more. A similar adjustment procedure applies to the single or triple breaker point system, although the exact method of aligning the timing index marks may vary.

The electromechanical ignition analyzer is now properly adjusted for checking any one of the following conditions. If either of the lamps remains on for 360° rotation of the cam, then this can indicate that there is dirt in the breaker points or corrosion or fouling of the points or the points are open too wide. That is, the points are not closing which would sequentially turn the lamp off. If the lamp does not illuminate at all, it indicates that point adjustment could be too narrow or a faulty condenser. That is, the points are closed and are not actually opening. It could also indicate a short across the points which could be caused by either one of the condensers. The fixed side of the point connected to the lamp which fails to illuminate can be checked for some type of short to ground. Thus, the ignition analyzer system provides a continuous and permanent indication of proper operation and adjustment of breaker points and ignition system.

Obviously, many modifications and variations of the present invention are possible in light of the above teachings. It is therefore to be understood that the full scope of the invention is not limited to the details disclosed herein and may be practiced otherwise than as specifically described.

What is claimed is:

1. An electromechanical engine timing device comprising:

an arcuate bracket formed to fit internally in an ignition system distributor having one or more breaker points;

at least one light-emitting diode securely mounted in a hole in said bracket;

current-limiting means connected between one side of said light-emitting diode and said bracket whereby when said bracket is secured in the distributor the plate acts as the ground terminal;

protective insulating means encapsulating the rear portion of said light-emitting diode and said current-limiting means; and connecting means connecting the other side of said light-emitting diode in parallel with said breaker points whereby said light-emitting diode continuously indicates the opening and closing of said breaker points.

2. The electromechanical engine timing device according to claim 1 wherein the number of light-emitting diodes mounted on said bracket equals the number of breaker points in said distributor with a separate light-emitting diode connected in parallel with each set of breaker points.

3. The electromechanical engine timing device according to claim 1 wherein said attaching means comprises a mounting hole in said bracket adapted to mate with a mounting hole on said distributor base plate whereby said bracket may be attached to said base plate with an existing screw.

* * * * *